US006206020B1

(12) United States Patent
Lynch

(10) Patent No.: US 6,206,020 B1
(45) Date of Patent: Mar. 27, 2001

(54) COLLAPSIBLE CANOPY FRAMEWORK AND STRUCTURE WITH ARTICULATING SCISSOR ASSEMBLIES

(76) Inventor: James P. Lynch, 6807 Dudley Cir., Arvada, CO (US) 80004

( * ) Notice: Subject to any disclaimer, the term of this patent is extended or adjusted under 35 U.S.C. 154(b) by 0 days.

(21) Appl. No.: 09/373,970

(22) Filed: Aug. 13, 1999

Related U.S. Application Data

(60) Provisional application No. 60/096,549, filed on Aug. 14, 1998.

(51) Int. Cl.[7] ..... E04H 15/38; E04H 15/44

(52) U.S. Cl. ..... 135/128; 135/131

(58) Field of Search ..... 135/128–130, 135/121–126, 87, 139, 141, 143, 25.1–25.31, 135, 156–159; 211/197–198, 200–201; 52/74, 79.5, 645–646

(56) References Cited

U.S. PATENT DOCUMENTS 402,755 * 5/1889 Lyon .
2,811,977 * 11/1957 McClish .
4,066,089 * 1/1978 Rainwater .
4,607,656 * 8/1986 Carter ..... 135/106
4,641,676 * 2/1987 Lynch ..... 135/110
4,779,635 * 10/1988 Lynch ..... 135/97
4,844,109 * 7/1989 Navarro ..... 135/103
5,005,896 * 4/1991 Li ..... 135/103
5,244,001 * 9/1993 Lynch ..... 135/103
5,283,993 * 2/1994 Sprung, Sr. ..... 135/102
5,634,483 * 6/1997 Gwin ..... 135/131
5,701,923 * 12/1997 Losi, Jr. et al. ..... 135/131
5,813,425 * 9/1998 Carter ..... 135/145
5,944,040 * 8/1999 Jang ..... 135/126
6,055,999 * 5/2000 Grey ..... 135/147

* cited by examiner

*Primary Examiner*—Daniel P. Stodola
*Assistant Examiner*—Jennifer E. Novosad
(74) *Attorney, Agent, or Firm*—Timothy J. Martin; Michael R. Henson; Mark H. Weygandt

(57) ABSTRACT

An expandable framework is used with a flexible covering to provide a portable shelter. The framework includes a plurality of upright support members, adjacent ones of which are interconnected by an edge scissor assembly. Each edge scissor assembly includes a plurality of scissor arms, and at least two of the scissor arms of each edge scissor assembly is formed by at least two articulating sections that move between a folded state when the framework is collapsed and an aligned state when the framework is expanded. The ends of the scissor assemblies are pivotally mounted to an upper and a lower fixed mount on the respective support member. As a result of the articulation, the mounts do not need to slide on the support members but rather can remain fixed.

20 Claims, 6 Drawing Sheets

COLLAPSIBLE CANOPY FRAMEWORK AND STRUCTURE WITH ARTICULATING SCISSOR ASSEMBLIES

This application claims the benefit of U.S. Provisional Application No. 60/096,549 filed Aug. 14, 1998.

FIELD OF THE INVENTION

The present invention generally relates to canopies which may be used to temporarily shelter against the elements, to provide privacy and the like. Specifically, however, the present invention is directed to a collapsible shelter which may be quickly erected for use yet easily collapsed for storage. In particular, the present invention concerns a canopy shelter which has articulating scissor assemblies.

BACKGROUND OF THE INVENTION

Portable shelters have been in existence since prehistoric time, but the modern era has seen an increasing need for greater sophistication in the quality and type of construction for portable shelter devices. In the last twenty to thirty years, the quick erect shelter industry has dramatically grown as the result of new technologies and fabrics. Support structures and design, especially in the field of light-weight tents and mountaineering shelters, have witnessed dramatic improvements. These developments manifest themselves in special application fields, but relatively little attention has been paid to the development of larger area shelters that are stored in a small collapsed state but which may be expanded with a minimum amount of effort into sturdy, large area shelters.

One response to this need is described in my U.S. Pat. No. 4,641,676. This patent shows a portable canopy structure having a framework that may be collapsed into a stored state yet which may be expanded and erected for use. The framework includes a plurality of upright support members which are interconnected by a plurality of scissor assemblies. The scissor assemblies have their upper outer ends fastened to the upright supports by removable mounts. The lower outer ends, however, are secured to a sliding mount which travels along the upright member between the erect and collapsed states. Internal scissor assemblies may be provided to support a central post, and a covering extends across the tops of the supports and is supported by the posts in a dome-like manner. This structure is also similar to that described in U.S. Pat. No. 4,607,656 issued Aug. 26, 1996 to Carter.

While the structures shown in my '676 Patent and in the Carter Patent do provide significant advantages over earlier structures, especially in the relative ease of both expansion and collapse, they nonetheless have some drawbacks. For example, in use, the scissor assemblies shown in these two structures are under compressive forces. When the scissor assemblies are subjected to forces transversely of their plane, the combination of this force with the compressive force can result in substantial bowing of the scissor assemblies and distortion of the canopy framework.

The structure described in my '676 Patent was modified by that disclosed in my U.S. Pat. No. 4,779,635 issued Oct. 15, 1988. In this patent, the canopy structure outwardly biased its corner support members so that the framework interconnecting the adjacent corner support members was placed in tension as opposed to compression. Nonetheless, the assembly shown in my '635 Patent was still subject to improvement in the scissor bar interconnections.

In an effort to enhance the stability of scissoring canopy frameworks, I developed the structures shown in my U.S. Pat. No. 5,244,001. In this patent, socket-type mounts were employed to fasten the ends of the scissor assemblies to the upright supports and to each other. The sockets provided by the mounts were formed to have spaced-apart, parallel side wall portions. The end scissor assemblies had outer end portions of rectangular cross-section so that each could be received in a close-fitted engagement between the parallel side wall portions thereby forming planar contact surfaces. The socket both simplified interconnection of the various structural members while at the same time provided resistance to lateral forces.

Despite the improvements taught in the above-noted patents, there remains a need for improved framework structures that provide quick erect canopy shelters. For example, the canopy frameworks disclosed in the above-referenced patents each utilize one rigid bracket and one slide bracket on the upright supports. The use of a slide bracket is necessary to allow a pair of upper and lower outer ends of the scissor assemblies to move apart from one another thereby allowing the scissor assemblies to move between the expanded state and the collapsed state. The present invention has been designed to eliminate the need for a slide bracket so that the ends of the scissor assemblies may each be secured to the upright supports at a fixed location.

SUMMARY OF THE INVENTION

It is an object of the present invention to provide a new and useful canopy framework which can be quickly and easily expanded for use yet collapsed for storage.

It is another object of the present invention to provide a canopy framework and canopy structure that employs scissoring structures that have fixed end points of attachment.

Still a further object of the present invention is to provide a canopy framework which is light-weight in construction so that it may be readily portable by a user.

Yet another object of the present invention is to provide a canopy framework which can be conveniently stored in a compact state yet which provides a comparatively large shelter are when erected for use.

According to the present invention, then, an expandable framework is provided that is adapted to move between an expanded state for supporting a covering above a support and a collapsed state for storage. Thus, the present invention also includes an expandable canopy adapted to provide shelter for a user.

In the broad form of the present invention, the expandable framework includes a plurality of upright support members which each have a bottom end positionable on the support surface and a top end opposite the bottom end. The support members are oriented alongside one another when in the collapsed state but are spaced apart from one another when in an expanded state. An upper mount is disposed at an upper fixed location on each corner support member, and a lower mount is disposed at a lower fixed location to each corner support member with the upper and lower mounts being spaced apart from one another a selected, fixed distance.

A plurality of edge scissor assemblies then interconnect the upright support members so that there is an edge scissor assembly in a connecting peripherally adjacent ones of the corner support members. Each edge scissor assembly includes a plurality of scissor arms hingedly connected to one another. At least two of the scissor arms of each edge scissor assembly define articulating members that are formed by at least two articulating arm sections movable between a folded state when the expandable framework is in the collapsed state and an aligned state when the expandable framework is in the expanded state. When in the aligned state, the two arm sections are oriented along parallel axes, and are preferably aligned with one another along a common axis. Each articulating member has a first outer end pivotally secured to one of the upper and lower mounts of the respective peripherally adjacent corner support member.

In the preferred embodiment, each articulating member is formed by three articulating arm sections. Here, two of the arm sections of each articulating member are linearly aligned with one another along a common axis and the third arm section of each articulating member is parallel to and off-set from the common axis. Two of the arm sections of each articulating member, moreover, are hinged to each other and to a central portion of another scissor arm, preferably, a non-articulating scissor arm. The hinged location is preferably at a central portion of the non-articulating scissor arm and the hinging occurs at a common location.

A first outer end of each articulating member is preferably secured to the lower mount on the respective upright support member. Moreover, an articulation bracket is used to hingedly inner connect two of the articulating arm sections together. The articulation bracket is preferably H-shaped in cross-section so that it has oppositely disposed channels, and an end portion of each arm member is then received in a respective one of the channels. A limit stop may be provided to prevent the arm sections from pivoting past the aligned state when moving from the folded state to the aligned state. Preferably, each edge scissor assembly is formed by a pair of scissor units with each scissor unit including a pair of scissor arms. Here, one of the scissor arms in each scissor unit forms one of the articulating members.

As noted, the present invention not only includes an expandable framework, but also is further directed to an expandable canopy utilizing such framework. Here, it is desired that a central pole structure be provided that is centrally disposed relative to the upright support members when the expandable framework is in the expanded state. A flexible covering then extends over a top portion of the framework when the framework is in the expanded state thus to provide shelter for a user.

These and other objects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

The present invention broadly relates to canopy frameworks and canopies incorporating such frameworks. More particularly, however, the present invention concerns a canopy framework wherein upright corner supports are interconnected by scissoring assemblies that include articulating arm portions allowing the scissoring assemblies to be attached to the corner supports at permanent locations yet which nonetheless allow framework to expand to a completely expanded state yet collapsed to a stored state in a compact configuration.

Figure 1:
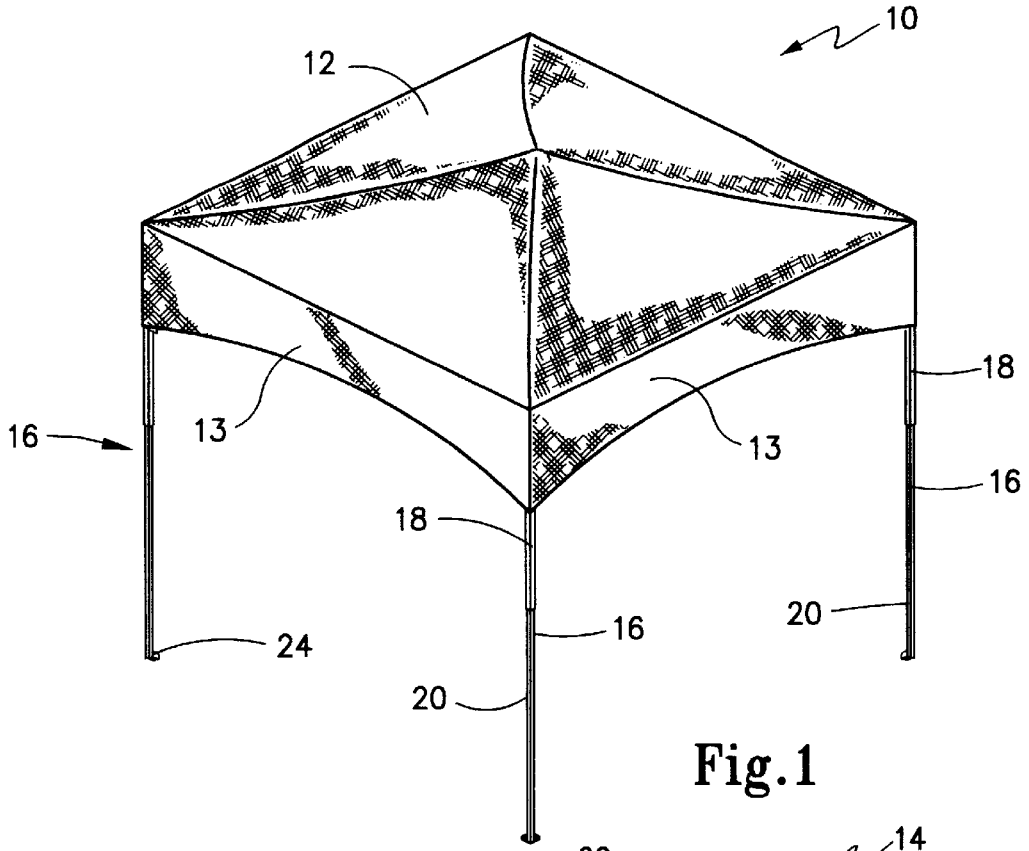
FIG. 1 is a perspective view of a canopy according to a first exemplary embodiment of the present invention.
Figure 2:
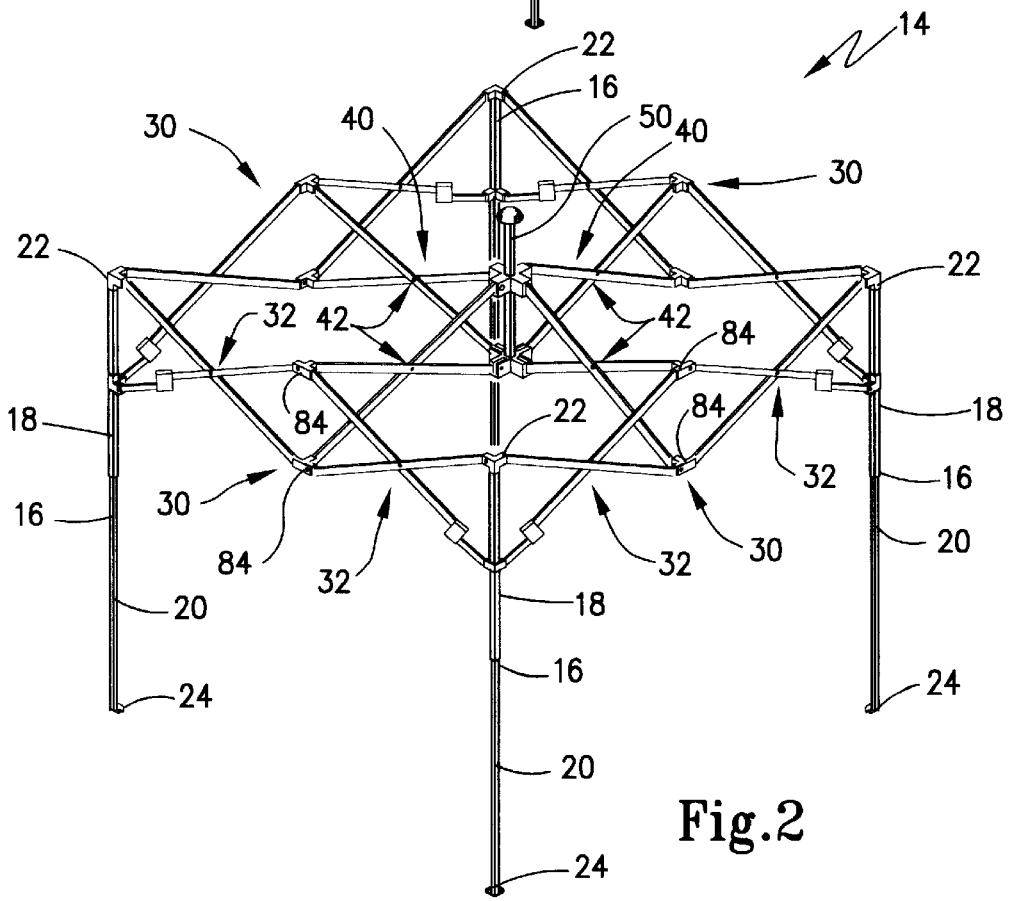
FIG. 2 is a perspective view of the canopy framework used for the canopy structure shown in FIG. 1.

A canopy 10 according to a first exemplary embodiment of the present invention is shown in FIG. 1 and includes a flexible covering 12 that is support by a framework 14. Framework 14, in turn, is depicted in FIG. 2 where it may be seen that framework 14 includes four upright support members 16 that define generally vertical legs. Each support member 16 is formed of a pair of telescoping tubular leg sections, including a lower leg section 20 that is telescopically received in upper leg section 18. Leg sections 18 and 20 may move between an extended condition, such as shown in FIG. 2 where they may be fastened by means of any suitable latch, such as a button latch (not shown) in a telescoped relation wherein leg section 20 is telescopically received in upper leg section 18. Each upright support member 16 has a lower end 24 that is adapted to rest on a support surface and an upper end 22 opposite lower end 24.

With further reference to FIG. 2, it may be seen that each upright support member 16 defines a corner support for framework 14 with peripherally adjacent pairs of support members 16 being interconnected to one another by an edge scissor assembly 30. Each edge scissor assembly 30 in the first exemplary embodiment is formed by a pair of scissor units 32 that are interconnected in end-to-end relation by brackets 84.

A central portion of each edge scissor assembly 30 is interconnected to a central portion of an opposite edge scissor assembly 30 by an internal scissor assembly 40 again formed by a two pairs of scissor units 42. A central post assembly 50 is also supported by internal scissor assemblies 40 in order to support the apex of covering 12 during use. Internal scissor assembly 40 provides a support structure for a central region of the flexible canopy covering 12. It should be understood that other support structures for the covering 12 could be substituted for scissor assembly 40 of the types known in the art.

Figure 3:
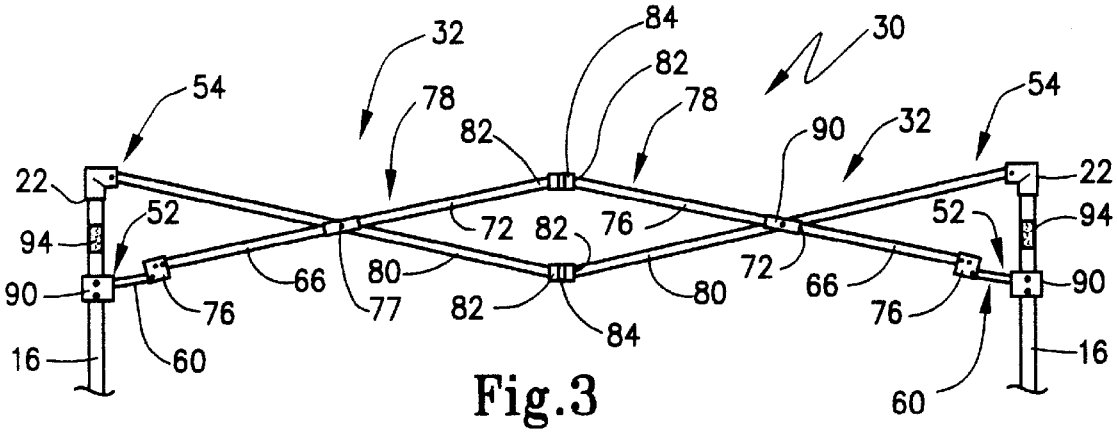
FIG. 3 is a side view in elevation showing a single edge scissor assembly of the canopy framework of FIG. 2 in the expanded state.

A representative edge scissor assembly 30 is best shown in FIGS. 3–6. In FIG. 3, edge scissor assembly 30 is shown in the erect state. Each edge scissor assembly 30 has a plurality of scissor arms 78 and 80 with a pair of first outer ends 52 and a pair of second outer ends 54. As is shown in FIGS. 3–6, each of first outer ends 52 is the terminal end of scissor arm 78 formed by a set of three articulating arm sections 60, 66 and 72, the operation of which is described in greater detail below. Articulating arm sections 60 and 66 are pivotally connected at ends 61 and 67, respectively, to one another by means of an articulation bracket 76 while an end 68 of articulating arm section 66 that is opposite outer end 52 is pivotally connected to a central portion of scissor arm 80 by a pivot bracket 77. Articulating arm sections 60, 66 and 72 together form a second scissor arm 78 which, along with scissor arm 80, completes scissor unit 32. Inner ends 82 of each scissor unit 32 that are opposite the respective outer ends 52 and 54 are pivotally connected to one another by means of interior brackets 84.

Again with reference to FIGS. 3–6, it may be seen that first outer ends 52 of edge scissor assembly 30 is connected to a lower mount 90 that is disposed on an upper end portion of upright support member 16 at a fixed location, that is, non-slideable. Similarly, second outer ends 54 of each edge scissor assembly 30 are pivotally secured to an upper mount 92 that is disposed at a fixed location at upper end 22 of each upright support member 16. Upper mount 92 and lower mount 90 are spaced-apart from one another a selected distance, and it should be understood that mounts 90 and 92 do not move relative to one another. A piece of filaform material 94 is disposed on each upright support member 16 between lower mounts 90 and upper mounts 92 to aid in securing covering 12 onto framework 14. To that end, it should be understood that the interior of side sections 13 of covering 12 have a mating hook and loop material (not shown) that operates to releaseably attached to filaform material 94.

Figure 4:
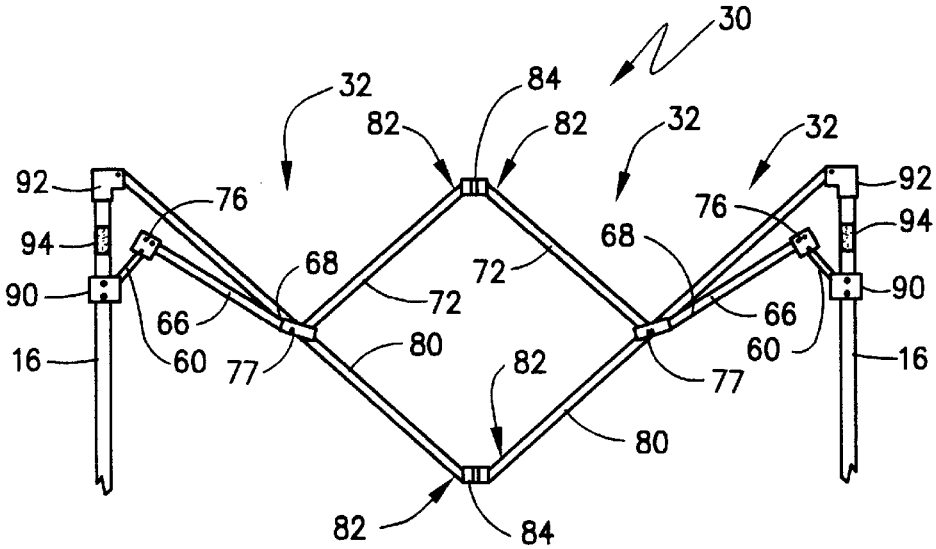
FIG. 4 is a side view in elevation of a single edge scissor assembly for the canopy framework of FIG. 2 shown in a first intermediate state between the expanded and collapsed states.
Figure 5:
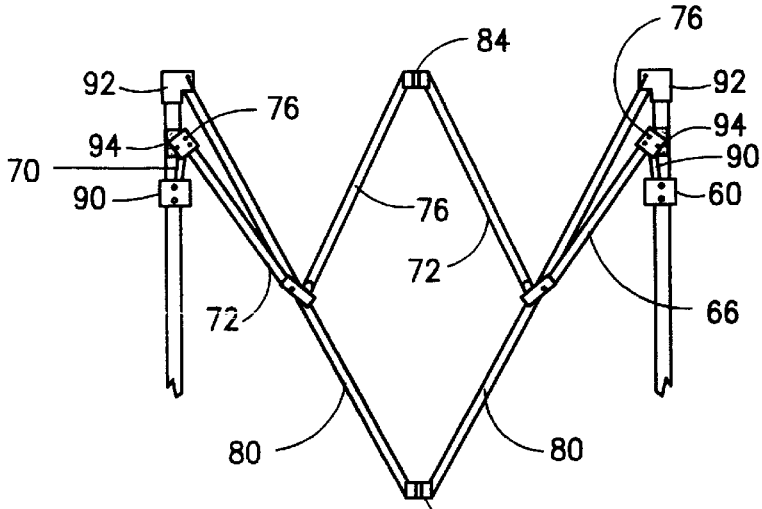
FIG. 5 is a side view in elevation showing an edge scissor assembly used for the canopy framework of FIG. 2 in a second intermediate state between the expanded and collapsed states.

In FIG. 3, edge scissor assembly 30 is shown in the fully erect state. Here, articulating arm section 66 and 72 are generally linearly aligned with one another in an aligned state along a common axis; articulating arm section 60 is parallel to this axis but is slightly offset therefrom. FIGS. 4 and 5 show edge scissor assembly 30 progressively moving toward the collapsed state so that FIG. 4 and FIG. 5 are, respectively, intermediates states between the fully extended state and the collapsed state. Thus, with reference to FIGS. 3–6, it may be appreciated that, as a pair of peripherally adjacent upright support members 16 are moved towards one another, scissor units 32 each collapse with brackets 84 moving apart from one another. Since lower mounts 90 and upper mounts 92 are rigidly affixed to an upright support member 16 it is necessary that articulating arm sections 60, 66 and 72 pivot or "fold" with respect to one another to accommodate this collapse. To this end, articulation bracket 76 allows the pair of articulating arm sections 60 and 66 to pivot from a generally parallel but offset orientation shown in FIG. 3 progressively, to a smaller angle as shown in FIGS. 4 and 5. As this occurs, articulating arm section 72 pivots relative to scissor arm 80 as well with respect to articulating arm section 66 at pivot bracket 77.

Figure 6:
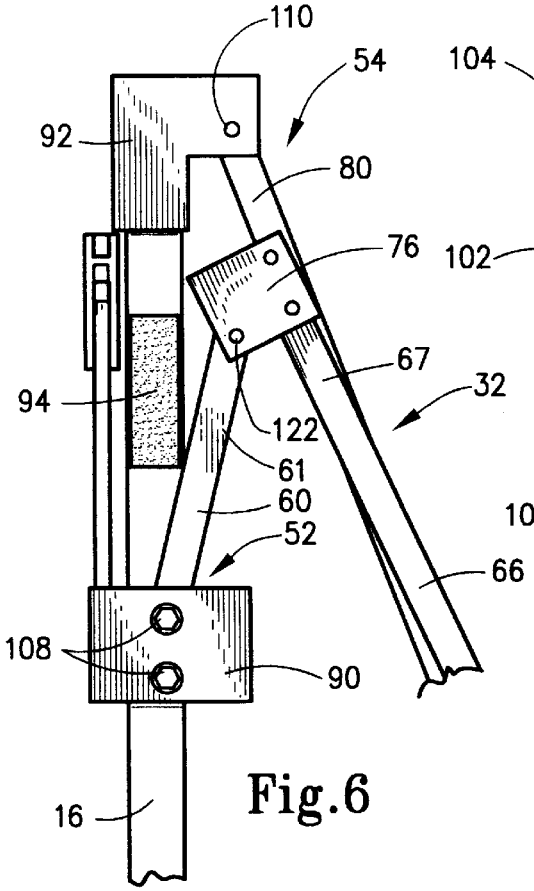
FIG. 6 is a side view in elevation of an upper end portion of an upright support showing the articulating scissor arm used for the canopy framework of FIG. 2.
Figure 8:
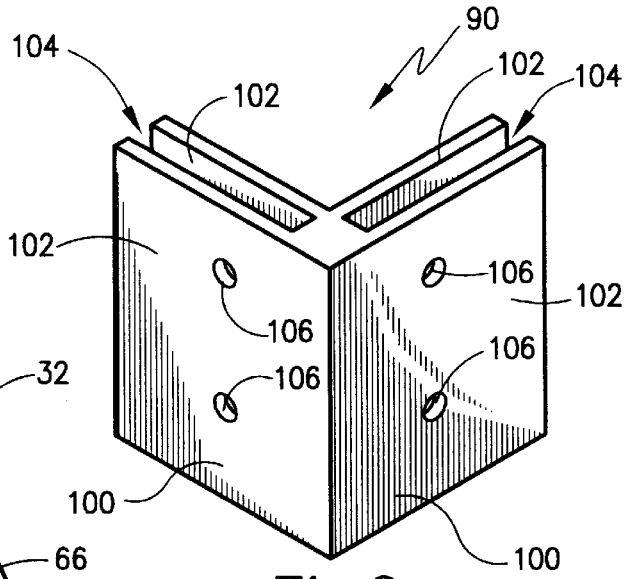
FIG. 8 is a perspective view of a corner bracket employed to mount the outer lower edge of a pair of scissor assemblies to a common upright support.
Figure 9:
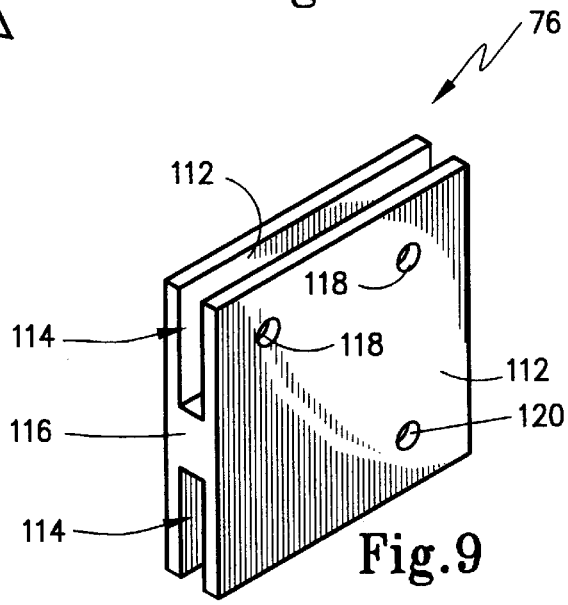
FIG. 9 is a perspective view of an articulation bracket used to interconnect the articulating sections of the articulating scissor arm according to the present invention.
Figure 10:
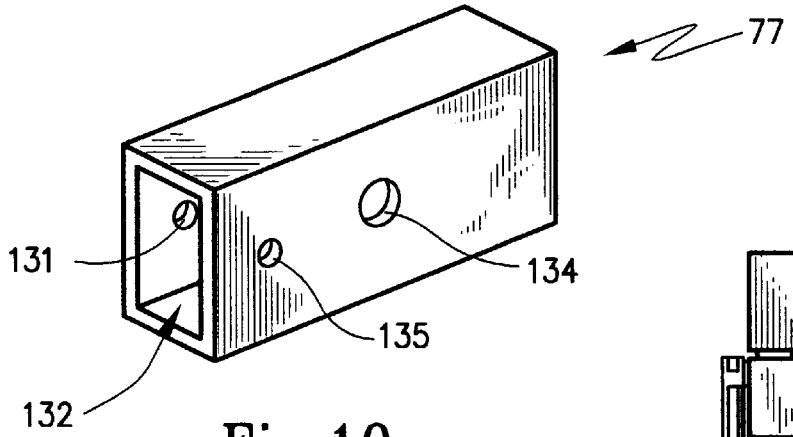
FIG. 10 is a perspective view of a pivot bracket used with the present invention.

With reference now to FIG. 6, the end portions of a respective scissor unit 32 is shown in greater detail, and FIGS. 8–10 show the various pivot brackets provided to interconnect the scissor arms to each other and to upright support members 16. In FIG. 6, articulating arm sections 60 and 66 have been further folded toward the collapsed state. As may be seen in greater detail, first outer end 52 of edge scissor assembly 30, as defined by an outer end of articulating arm section 60, is pivotally mounted to upright support member 16 by means of lower mount 90. To this end, lower mount 90 is formed by a pair of wing sections 100 which are oriented at right angles with respect to one another and may be integrally molded from any suitable material such as a structural plastic. Wing sections 100 are each formed by a pair of spaced-apart webs 102 so that a socket 104 is formed therebetween. A pair of holes 106 are formed centrally of each wing section 100 to accommodate bolts 108 that secure lower mount 90 to upright support member 16 at the affixed location noted above. The upper bolt 108 also pivotally secures outer end 52 to upright support member 16. The second outer end 54 of edge scissor assembly 30 is secured to upper mount 92 by means of a suitable connecting pin 110 so that scissor arm 80 may freely pivot with respect to upper mount 92.

Articulating arm sections 60 and 66 are pivotally interconnected by means of articulation bracket 76 that is best shown in FIG. 9. Here, articulation bracket 76 is H-shaped in configuration and is formed by a pair of side plates 112 that are spaced apart from one another to define oppositely opening channels 114. Side plates 112 are joined together by means of a web 116. A pair of holes 118 are formed through side plates 112 on one margin thereof so as to rigidly mount end 67 of articulating arm section 66. Thus, it should be appreciated that channel 112 is sized for close-fitted mated relation with the rectangular cross-section of articulating arm section 66. A hole 120 is formed through the opposite margin from holes 118 so as to receive a pin 122 that pivotally secures end 61 of articulating arm section 60. Thus, it may be seen that articulating arm sections 60 and 66 freely pivot with respect to one another about pin 122. The sizing of sockets 104 and channels 114 are selected to provide lateral stability to the scissor arms by providing planar sliding surfaces similar to that described with respect to my U.S. Pat. No. 5,244,001.

Figure 7:
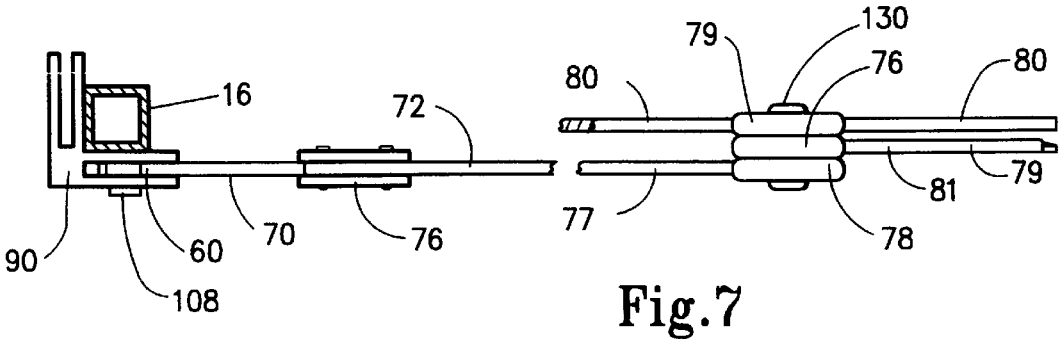
FIG. 7 is a top plan view, in partial cross-section, showing the articulating arm of the scissor assemblies according to the first exemplary embodiment of the present invention.

With reference again to FIG. 7, it may be seen that, centrally of scissor unit 32 are two pivot brackets 78 and a fitting 79 which are connected by means of a non-compressible pin 130 so that ends 67 of articulating arm section 66 and end 73 of articulating arm section 72 are pivotally connected to the central location of scissor arm 80. Scissor arm 80 is located interiorily of framework 14 while articulating arm sections 60 and 66 are located exteriorly thereof. Articulating arm section 72 is then sandwiched between articulating arm section 66 and scissor arm 80.

The structure of pivot bracket 77 is best shown in FIG. 10. Here, it may be seen that pivot bracket 77 is in the form of a sleeve having a passageway 132 extending therethrough. Passageway 132 is sized for close-fitted mated engagement with the cross-section of the respective ends of articulating arm sections 66 and 72 and the central portion of scissor arm 80. A hole 134 is provided to accommodate connecting pin 130 noted above, and facing holes 135 secure the respective ends in brackets 77 by any suitable pin or bolt. Fitting 79 is similarly constructed as bracket 77 and slides onto scissor arm 80.

Figure 11:
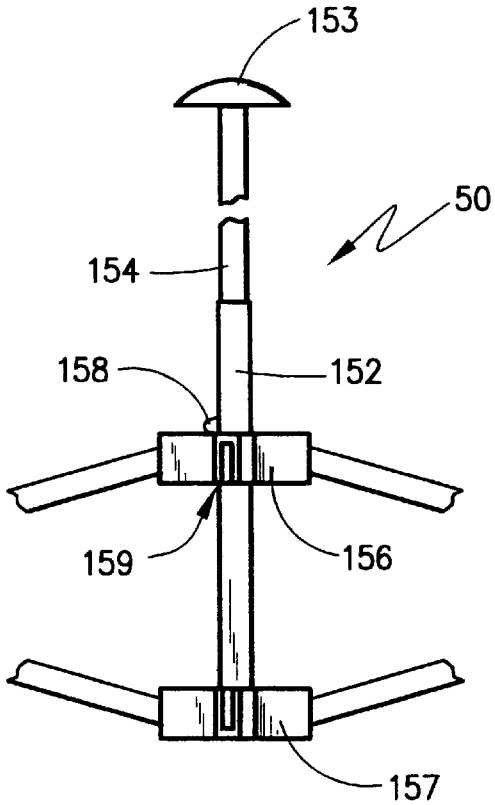
FIG. 11 is a side view in elevation, partially broken-away, showing the central post assembly of the canopy framework of FIG. 2.

The structure of central post assembly 50 is shown in FIG. 11. Here, it may be seen that central post assembly 50 is formed by pair of telescoping tubular sections 152 and 154. Tubular section 152 is supported by means of a pair of brackets 156 and 157. Bracket 156 is provided with a central passageway 159 so that tubular section 152 may slide therethrough. Bracket 157 forms a base to support the dome end of tubular section 152. A button latch 158 is provided to retain tubular section 154 in a selected telescopic extension with respect to tubular section 152. A dome piece 153 is disposed at the upper end of tubular section 154 so as to support the apex of canopy covering 12.

Figure 12:
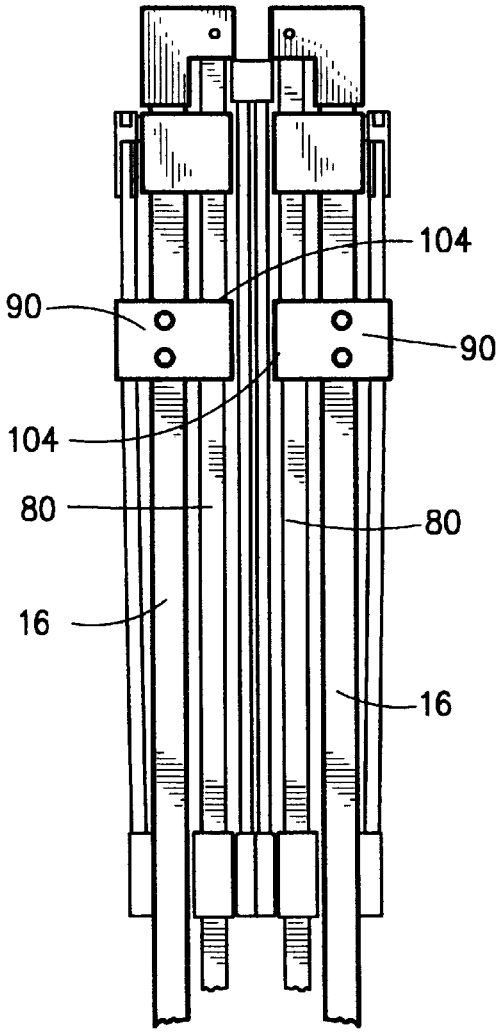
FIG. 12 is a side view in elevation of the upper portion of the canopy framework of FIG. 2 shown in the fully collapsed state.

With reference now to FIG. 12, framework 14 may be seen in the collapsed state. Here, upright support members 16 have been moved so that they are oriented alongside one another with edge scissor assemblies 30 and internal scissor assemblies 40 being completely folded. Sockets 104, in this state, act to receive a mid-portion of scissor arm 80 to help rigidify framework 14 when in the collapsed state. In the expanded state, upright support members 16 are spaced-apart from one another.

Figure 13:
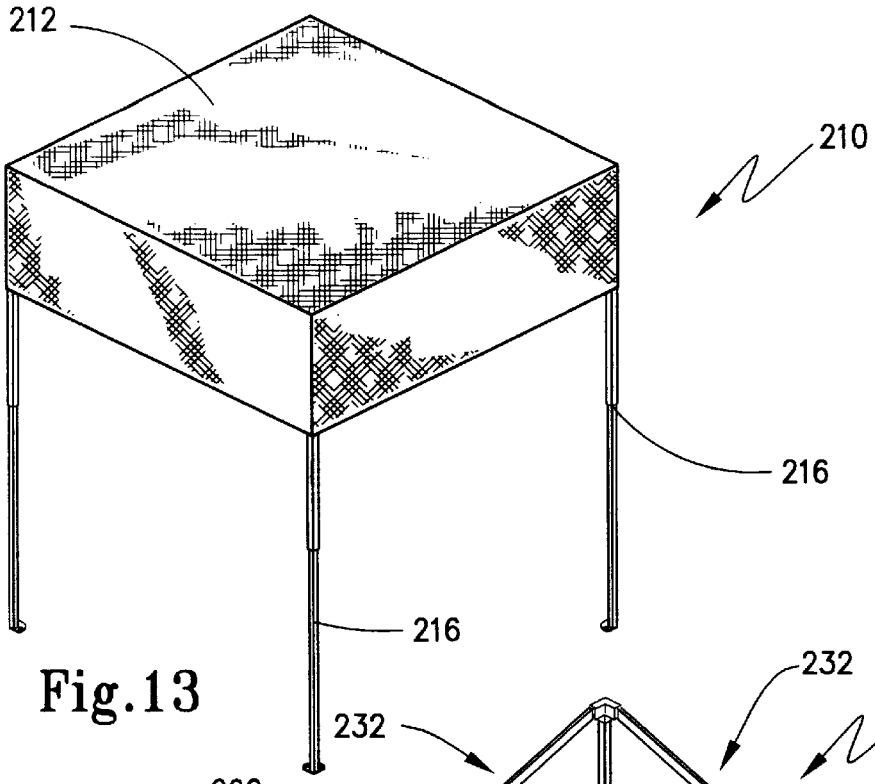
FIG. 13 is a perspective view of a second exemplary embodiment according to the present invention.
Figure 14:
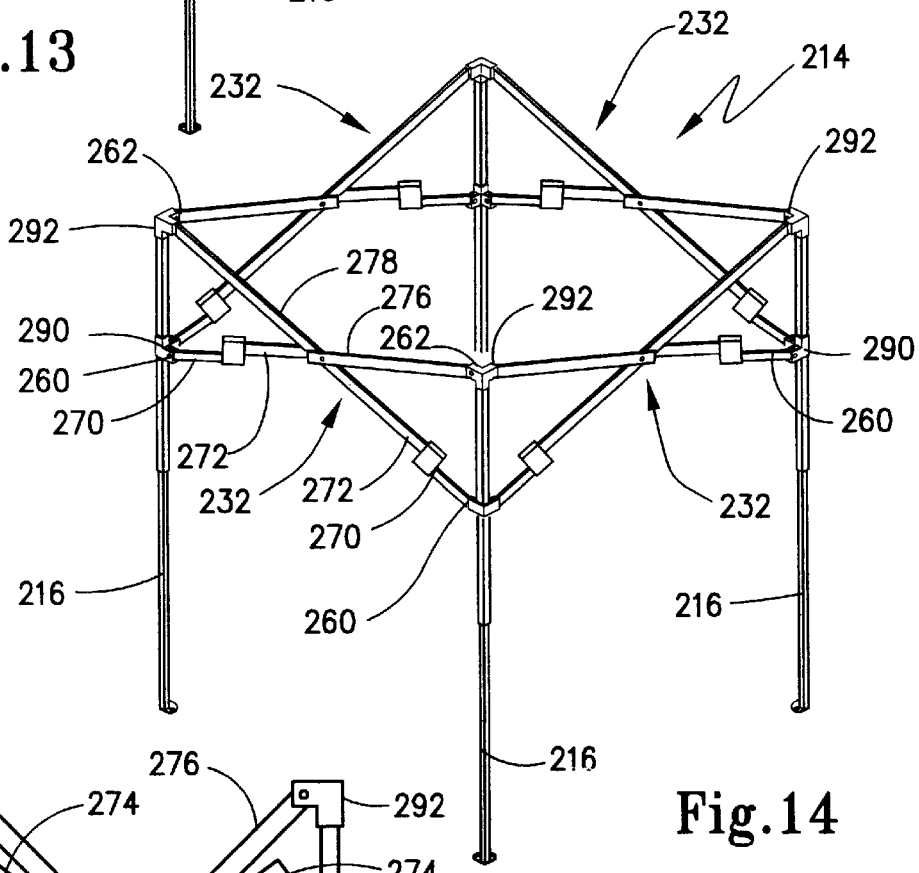
FIG. 14 is a perspective view of the framework used for the canopy shown in FIG. 13.
Figure 15:
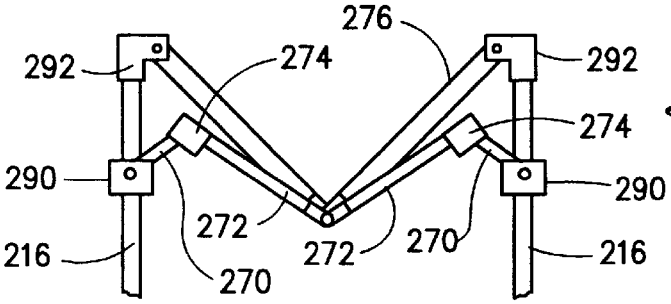
FIG. 15 is a side view in elevation of the edge scissor assembly according to the second exemplary embodiment.

A second exemplary embodiment of the present invention is shown in FIGS. 13–15. Here, canopy 210 includes a covering 212 that is supported by frame 214 above a support surface. Frame 214 includes four upright support members 216, again formed by telescoping sections. Framework 214 departs from the structure described above in that the scissor assembly includes only a single scissor unit 232 that is employed for the expanding and collapsing of framework 214. Each scissor unit 232 is formed by a pair of scissor arms 278 that has first outer ends 260 pivotally mounted to lower mounts 290 while second outer ends 262 are pivotally secured to upper mounts 292. Each scissor arm 278 includes three articulating arm sections 270, 272 and 276, the structure of which is identical to that described with respect to framework 14 and need not be repeated. However, with reference to FIG. 15, it may be seen that, as upright supports 216 are moved towards one another, both of articulating arm pairs 270 and 272 fold with respect to one another allowing the collapse of the canopy framework into the collapsed state.

Figure 16:
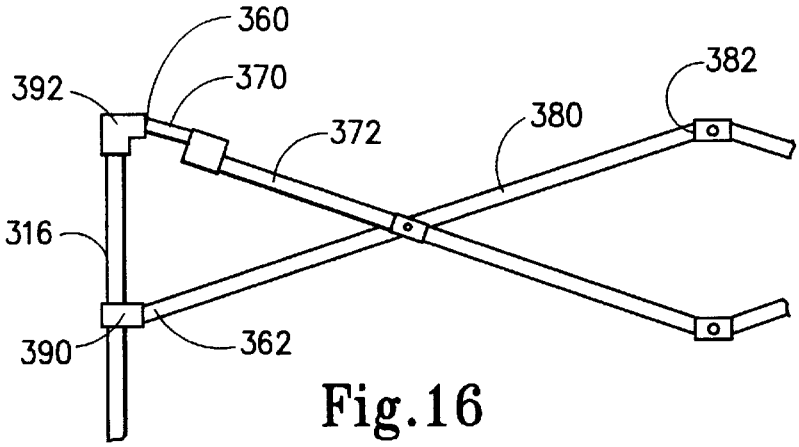
FIG. 16 is a side view in elevation showing the articulating scissor according to a third exemplary embodiment of the present invention in a fully erect state.
Figure 17:
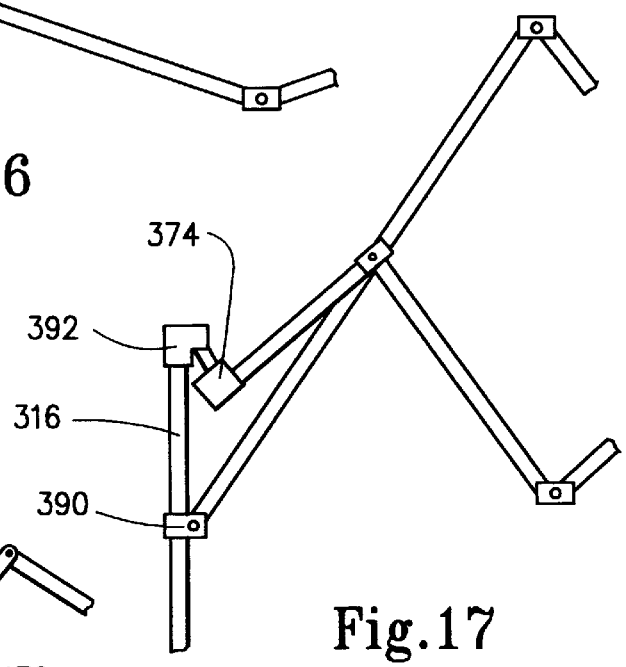
FIG. 17 is a side view in elevation of the scissor unit shown in FIG. 16 in an intermediate state between the expanded and collapsed states.

A third exemplary embodiment of the present invention is shown in FIGS. 16 and 17. Here, the structure is identical to that described with respect to framework 14 except that the positioning of articulating arms 370 and 372 are reversed. Accordingly, outer end 360 is now secured to upper mount 392 while outer end 362 is secured to lower mount 390. While the structure shown in FIGS. 16 and 17 functionally works, it has a disadvantage in that end 382 of scissor arm 380 elevates when the framework is moved into the collapsed state so that it does not nest within the region bounded by upright support members 316. This structure would have an advantage, however, in that it would provide a narrower cross-section of folding even though the dimensional length is greater.

Figure 19:
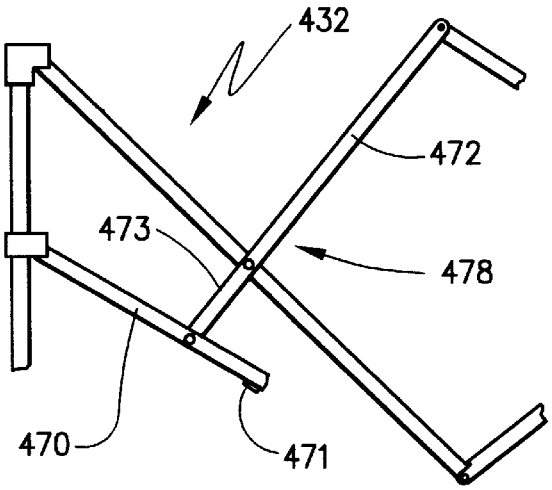
FIG. 19 is a side view in elevation of the scissor unit shown in FIG. 18 but in an intermediate state between the expanded and collapsed states.
Figure 18:
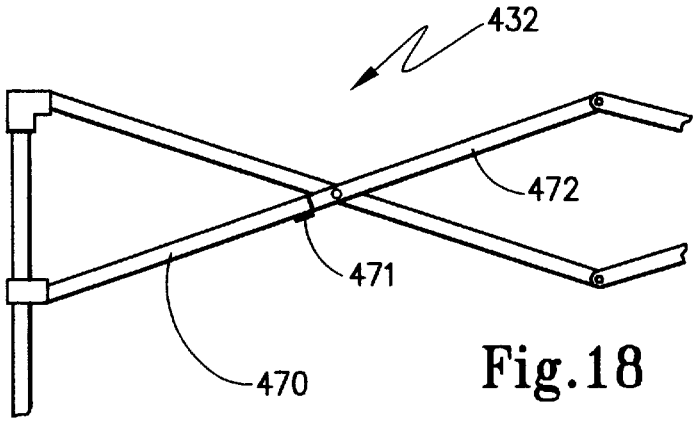
FIG. 18 is a side view in elevation of a scissor unit according to a fourth exemplary embodiment of the present invention in an expanded state.

A fourth exemplary embodiment of a scissor unit 432 is shown in FIGS. 18 and 19. Here, each scissor arm 478 is formed by two articulating members 470 and 472 that are linearly aligned in an aligned state when the canopy framework is expanded. Articulating arm section 472 extends past the central pivot location to have a portion 473 that is then pivotally secured to articulating arm section 470. A limit stop lip 471 is provided to prevent angular pivoting of articulating arms 470 and 472 past the linear orientation, i.e., the aligned state.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

What is claimed is:

1. An expandable framework adapted to move between an expanded state for supporting a covering above a support surface and a collapsed state for storage, comprising:

(a) a plurality of upright support members each having a bottom end positionable on the support surface and a top end opposite the bottom end, said support members being oriented alongside one another in the collapsed state and spaced apart from one another when in the expanded state;

(b) an upper mount fixed at an upper fixed location to each said support member;

(c) a lower mount fixed at a lower fixed location to each said support member, said upper and lower mounts spaced apart from one another by a pre-determined distance; and (d) a plurality of edge scissor assemblies whereby each of said edge scissor assemblies interconnects peripherally adjacent ones of said support members, each said edge scissor assembly including a plurality of scissor arms hingedly connected to one another, at least two of said scissor arms defining articulating members formed by at least two articulating arm sections that are movable between a folded state when the expandable framework is in the collapsed state and an aligned state when the expandable framework is in the expanded state whereby the two articulating arm sections are oriented along parallel axes with respect to one another, each said articulating member having a first outer end pivotally secured to one of said upper and lower mounts of a respective peripherally adjacent said support member.

2. An expandable framework according to claim 1 wherein the arm sections of each said articulating member are substantially linearly aligned with one another when in the aligned state.

3. An expandable framework according to claim 1 wherein each said articulating member is formed by three articulating arm sections.

4. An expandable framework according to claim 3 wherein two of said arm sections of each said articulating member are linearly aligned with one another along a common axis and a third arm section of each said articulating member is offset with respect to the common axis.

5. An expandable framework according to claim 3 wherein two of said arm sections of each said articulating member are hinged to each other and to a central portion of another one of said scissor arms.

6. An expandable framework according to claim 5 wherein the two of said arm sections of each said articulating member are hinged to each other and to a central portion of another one of said scissor arms at a common location.

7. An expandable framework according to claim 1 including a limit stop operative to prevent said arm sections from pivoting past the aligned state when moving from the folded state to the aligned state.

8. An expandable framework according to claim 1 wherein the first outer end of each said articulating member is pivotally secured to said lower mount.

9. An expandable framework according to claim 1 including an a articulation bracket hingedly connecting said two articulating arm sections together.

10. An expandable framework according to claim 9 wherein said articulation bracket is H-shaped in cross-section so that it has oppositely disposed channels, an end portion of each said articulating arm section being received in a respective one of said channels.

11. An expandable framework according to claim 1 including a center pole support structure centrally disposed relative to said support members when the expandable framework is in the expanded state.

12. An expandable framework according to claim 1 wherein each said edge scissor assembly is formed by a pair of scissor units, each said scissor unit including a pair of scissor arms.

13. An expandable framework according to claim 12 wherein one of the scissor arms in each said scissor unit forms one of said articulating members.

14. An expandable canopy adapted to move between an expanded state for supporting a covering above a support surface and a collapsed state for storage, comprising:

(a) a framework including (i) a plurality of upright support members each having a bottom end positionable on the support surface and a top end opposite the bottom end, said support members being oriented alongside one another in the collapsed state and spaced apart from one another when in the expanded state;

(ii) an upper mount fixed at an upper fixed location to each said support member;

(iii) a lower mount fixed at a lower fixed location to each said support member, said upper and lower mounts spaced apart from one another by a predetermined distance; and (iv) a plurality of edge scissor assemblies whereby each of said edge scissor assemblies interconnects peripherally adjacent ones of said support members, each edge scissor assembly including a plurality of scissor arms hingedly connected to one another, at least two of said scissor arms defining articulating members formed by at least two articulating arm sections that are movable between a folded state when the expandable framework is in the collapsed state and an aligned state when the expandable framework is in the expanded state whereby the two articulating arm sections are oriented along parallel axes with respect to one another, each said articulating member having a first outer end pivotally secured to one of said upper and lower mounts of a respective peripherally adjacent said support member; and (b) a flexible covering extending over a top portion of said framework when said framework is in the expanded state.

15. An expandable canopy according to claim 14 wherein each said articulating member is formed by three articulating arm sections and wherein two of said arm sections of each articulating member are hinged to each other and to a central portion of another one of said scissor arms.

16. An expandable canopy according to claim 15 wherein the two of said arm sections of each said articulating member are hinged to each other and to a central portion of another one of said scissor arms at a common location.

17. An expandable canopy according to claim 14 wherein the first outer end of each said articulating member is pivotally secured to said lower mount.

18. An expandable canopy according to claim 14 including a center pole support structure centrally disposed relative to said upright support members when the expandable framework is in the expanded state.

19. An expandable canopy according to claim 14 wherein each said edge scissor assembly is formed by a pair of scissor units, and each said scissor unit including a pair of said scissor arms.

20. An expandable framework according to claim 19 wherein one of the scissor arms in each said scissor unit forms one of said articulating members.

* * * * *